United States Patent [19]

Dietrich

[11] Patent Number: 4,937,933

[45] Date of Patent: Jul. 3, 1990

[54] APPARATUS FOR THE INTRODUCTION OF A SLEEVE INTO A TUBE OF A STEAM GENERATOR

[75] Inventor: Alban Dietrich, Hassloch, Fed. Rep. of Germany

[73] Assignee: ABB Reaktor GmbH, Mannheim, Fed. Rep. of Germany

[21] Appl. No.: 337,562

[22] Filed: Apr. 12, 1989

[30] Foreign Application Priority Data

Apr. 14, 1988 [DE] Fed. Rep. of Germany ..... 3812351

[51] Int. Cl.[5] ..... B21D 53/00

[52] U.S. Cl. ..... 29/726; 29/402.09; 29/890.031

[58] Field of Search ..... 29/726, 157.3 C, 157.4, 29/157.3 R, 402.09, 402.01

[56] References Cited

U.S. PATENT DOCUMENTS

| | | | |
|---|---|---|---|
| 3,835,520 | 9/1974 | Sismore | 29/726 |
| 4,213,239 | 7/1980 | Filer | 29/726 |
| 4,369,569 | 1/1983 | Armstrong, Jr. | 29/726 |
| 4,654,943 | 4/1987 | Rabe | 29/157.4 |
| 4,672,741 | 6/1987 | Zafred et al. | 29/726 |
| 4,707,912 | 11/1987 | Haller | 29/726 |
| 4,771,526 | 9/1988 | Arzenti et al. | 29/726 |
| 4,779,445 | 10/1988 | Rabe | 29/157.4 |

*Primary Examiner*—Howard N. Goldberg
*Assistant Examiner*—I. Cuda
*Attorney, Agent, or Firm*—Herbert L. Lerner; Laurence A. Greenberg

[57] ABSTRACT

In an apparatus for the introduction of a repair sleeve into a tube of a steam generator, difficulties are encountered if the axes of the repair sleeve and the steam generator tube are not aligned. Furthermore, problems are encountered in positioning the repair sleeve exactly in its end position. In order to achieve a precise centering and positioning of the repair sleeve, an aperture is formed by a connecting sleeve which is resiliently supported in the axial direction. The repair sleeve is clamped between a first shoulder of a holding grip and a centering piece which has a variable outside diameter. In such a structure, the greatest diameter of the shoulder surface is less than the inside diameter of the connecting sleeve. The holding grip is associated with a second shoulder having an axial distance from the first shoulder which is further away from the tube sheet than the first shoulder by the height of the connecting sleeve. The shoulder surface of the second shoulder comes into contact with an end surface of the connecting sleeve facing away from the tube sheet, while an end surface of the connecting sleeve facing the tube sheet contacts the tube sheet.

11 Claims, 3 Drawing Sheets

APPARATUS FOR THE INTRODUCTION OF A SLEEVE INTO A TUBE OF A STEAM GENERATOR

The invention relates to an apparatus for the introduction of a repair sleeve into a tube ending in a tube sheet of a steam generator, including a movable holding device movable in axial direction of the steam generator for transferring the sleeve in partial strokes to a stationary holding device being associated with the tube sheet and integrated in a holding plate fixed relative to the tube sheet, the sleeve being clamped in an aperture of the holding plate disposed coaxially to the tube, during a return stroke of the movable holding device.

Such an apparatus is known from German Patent DE-PS No. 35 09 177. However, problems arise with that device during the introduction of the sleeve if the axes of the sleeve and the steam generator tube are not aligned. Furthermore, an exact positioning of the sleeve in its end position presents difficulties.

It is accordingly an object of the invention to provide an apparatus for the introduction of a sleeve into a tube of a steam generator, which overcomes the hereinaforementioned disadvantages of the heretofore-known devices of this general type, which ensures a centering of the sleeve upon entering into the steam generator tube and which achieves an exact positioning of the installation position of the sleeve.

With the foregoing and other objects in view there is provided, in accordance with the invention, an apparatus for the introduction of a repair sleeve into a tube ending in a tube sheet of a steam generator, comprising a holding plate being fixed relative to the tube sheet and having an aperture formed therein coaxially with a tube, a stationary holding device associated with the tube sheet and integrated in the holding plate, a movable holding device being movable in axial direction of the steam generator for transferring the sleeve in partial strokes to the stationary holding device and for performing a return stroke, a connecting sleeve being resiliently supported in axial direction in the aperture or forming the aperture, the connecting sleeve having a given height, a given inside diameter, an end surface facing away from the tube sheet and an end surface facing toward and contacting the tube sheet, a holding grip including a first shoulder having a surface with a greatest diameter being smaller than the given inside diameter of the connecting sleeve and a second shoulder with a surface for contacting the end surface of the connecting sleeve facing away from the tube sheet, the first shoulder being spaced from the tube sheet by a first axial distance, the second shoulder being spaced from the tube sheet by a second axial distance being greater than the first distance by an amount substantially equal to the given height, and a centering piece with a variable outside diameter, the sleeve being clamped between the first shoulder and the centering piece during the return stroke of the holding device.

The interaction between the holding grip and the connecting sleeve, as well as the centering piece which is connected to the holding grip through the tie rod and has a variable outside diameter, ensures that after a trouble-free centering of the sleeve, it is possible to carry out an exact positioning relative to the tube sheet and finally a reliable removal of the centering piece, which after all has to be led out through the sleeve and then fixed in the tube.

In accordance with another feature of the invention, the tube has an inner wall surface and the sleeve has an outer wall surface, and there is provided a tie rod passing through the sleeve and extending between and interconnecting the centering piece and the holding grip, and an expanding device disposed on the tie rod for establishing a connection between the outer wall surface of the sleeve and the inner wall surface of the tube once positioning of the sleeve has taken place. Consequently, the tie rod can also be used additionally for another function.

In accordance with a further feature of the invention, the connecting sleeve has a flange, and there is provided a bush associated with the holding plate for guiding the connecting sleeve, the bush having an end surface facing the holding plate with clearances formed therein, and springs disposed in the clearances and protruding beyond the end surface of the bush for supporting the flange.

In accordance with an added feature of the invention, the connecting sleeve has an axis and an inner wall surface, the bush and the connecting sleeve have walls with clearances formed therein opposite the inner wall surface of the connecting sleeve, the stationary holding device has a clamping piece movable substantially perpendicularly to the axis of the connecting sleeve and passing through the clearances, and the sleeve is clamped by pressing against the inner wall surface of the connecting sleeve. This is done in order to provide holding of the sleeve during the return movement of the axially shifted holding device.

In accordance with an additional feature of the invention, the springs have a given excursion, and the clearance formed in the wall of the connecting sleeve has an axial dimension large enough to permit the connecting sleeve to pass through with the clamping piece along all of the given spring excursion.

In accordance with yet another feature of the invention, there is provided a contact being triggered for interrupting entry movement of the sleeve once the second shoulder of the holding grip contacts the end surface of the connecting sleeve facing away from the tube sheet This feature provides exact control of the vertically movable holding device.

In accordance with yet a further feature of the invention, the sleeve has an end surface, the centering piece includes a spreading bolt having one end to be connected to the tie rod, another end, an axis and a slot penetrating the spreading bolt transverse to the axis thereof, a spreading sleeve engaging the spreading bolt and having an end surface and an outside diameter, and a threaded sleeve partially engaging the spreading bolt and the spreading sleeve and being connected to the other end of the spreading bolt, a locking bolt passing through the slot, being fixed in the spreading sleeve and protruding beyond the outside diameter of the spreading sleeve, a ball spring-mounted on the locking bolt to be clipped into an inner groove formed in the threaded sleeve, when the end surface of the spreading sleeve contacts the end surface of the sleeve. With a centering sleeve constructed in this way, both the centering of the sleeve and the removal of the centering piece after fixing of the sleeve relative to the steam generator tube can be carried out reliably.

In order to facilitate the setting of the centering sleeve to the required diameter during clamping and introduction of the sleeve, in accordance with yet an added feature of the invention, the other end of the spreading bolt has a center bore formed therein in communication with the slot for receiving a push rod for displacing the locking bolt into clipped engagement with the inner groove, before connecting the spreading bolt to the tie rod.

In accordance with yet an additional feature of the invention, the threaded sleeve is released by the spreading sleeve, and the outside diameter of the centering piece is reduced to a dimension allowing a movement of the centering piece through the sleeve, once a connection between the outer wall surface of the sleeve and inner wall surface of the tube has been established by a movement of the tie rod away from the tube sheet.

In accordance with still another feature of the invention, the end surface of the spreading sleeve has a bevel formed thereon.

In accordance with a concomitant feature of the invention, the end surface of the sleeve faces the centering piece and has a bevel formed thereon contacting the bevel on the spreading sleeve during pulling movement of the tie rod.

The reduction movement of the outside diameter of the centering piece is assisted by the bevel on the end surface of the spreading sleeve and if appropriate by interaction with the bevel on the end surface of the sleeve.

Other features which are considered as characteristic for the invention are set forth in the appended claims.

Although the invention is illustrated and described herein as embodied in an apparatus for the introduction of a sleeve into a tube of a steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
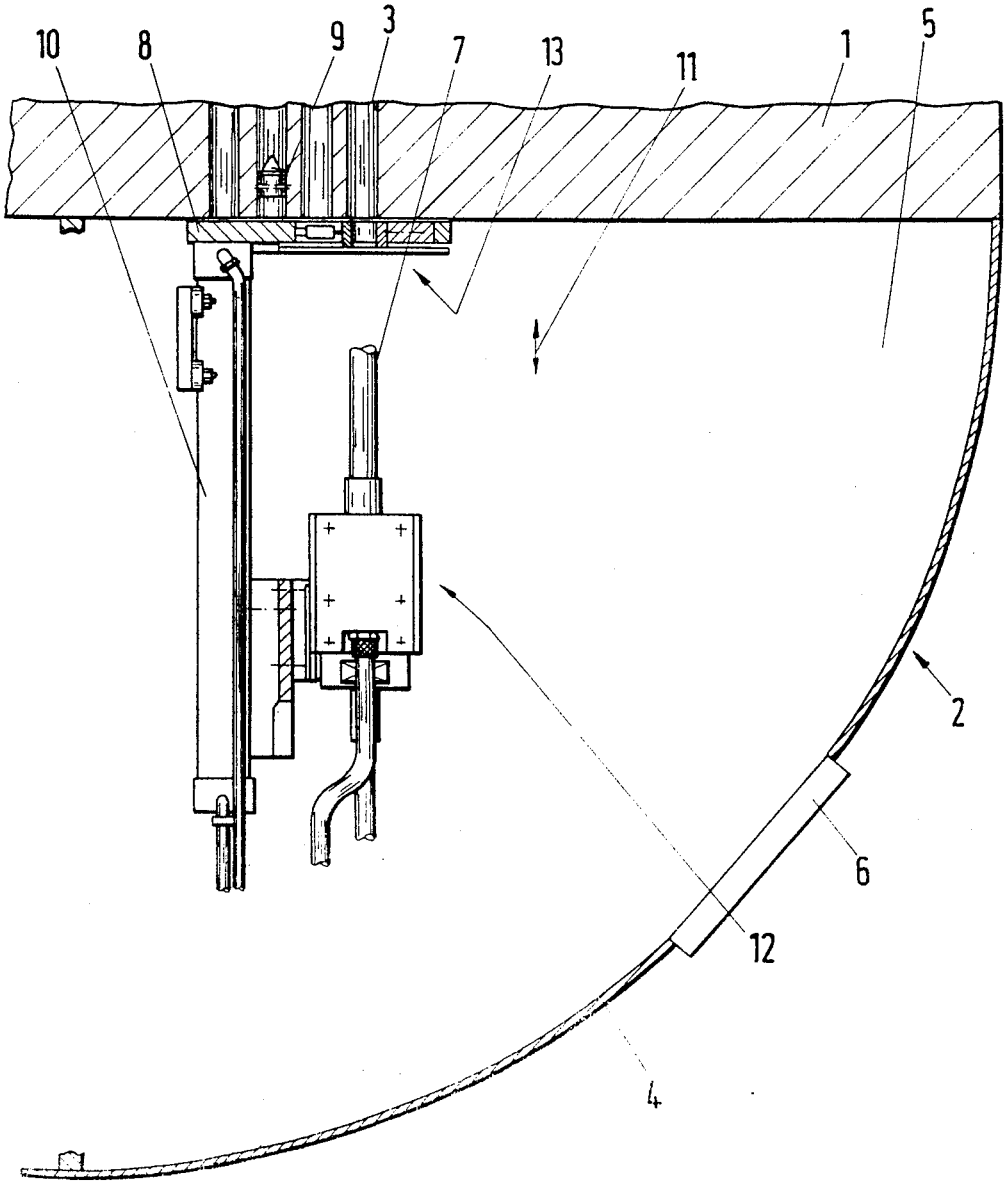
FIG. 1 is a fragmentary, diagrammatic, cross-sectional view of part of a steam generator with an apparatus for the introduction of a sleeve into a steam generator tube.

Referring now to the figures of the drawings in detail and first, particularly, to FIG. 1 thereof, there is seen a tube sheet 1 of a steam generator 2, in which a plurality of tubes 3 end in the sheet, although only some of the tubes are shown for reasons of clarity. The tube sheet 1, together with a hemispherically constructed base 4, bounds or defines a steam generator chamber 5. The steam generator chamber 5 is accessible through a manhole 6, through which an apparatus for the introduction of a repair sleeve 7 into a leaky tube 3 is introduced. Such leakages often occur in the region of the tube sheet 1 or just above the tube sheet. A sleeve 7 introduced into such a defective tube engages the location of the leak of the tube 3 and is connected thereto in a sealed manner. The apparatus which is only diagrammatically represented in FIG. 1 is formed of a holding plate 8, which is fixed relative to the tube sheet 1 with the aid of clamping elements 9. The holding plate 8 carries a drive unit 10, which receives a holding device 12 for the sleeve 7. The holding device 12 is movable in axial direction 11 of the steam generator 2. The drive unit 10 may in this case be constructed as a cylinder controlled by a medium, as a spindle drive or the like. A stationary holding device 13 is also integrated in the holding plate 8. The device 13 holds the sleeve 7 during the entry of the same in a stroke-by-stroke fashion, until the holding device 12 which is movable in axial direction, has executed its return stroke and has gripped the sleeve 7 for preparation of a new introduction stroke.

Figure 2:
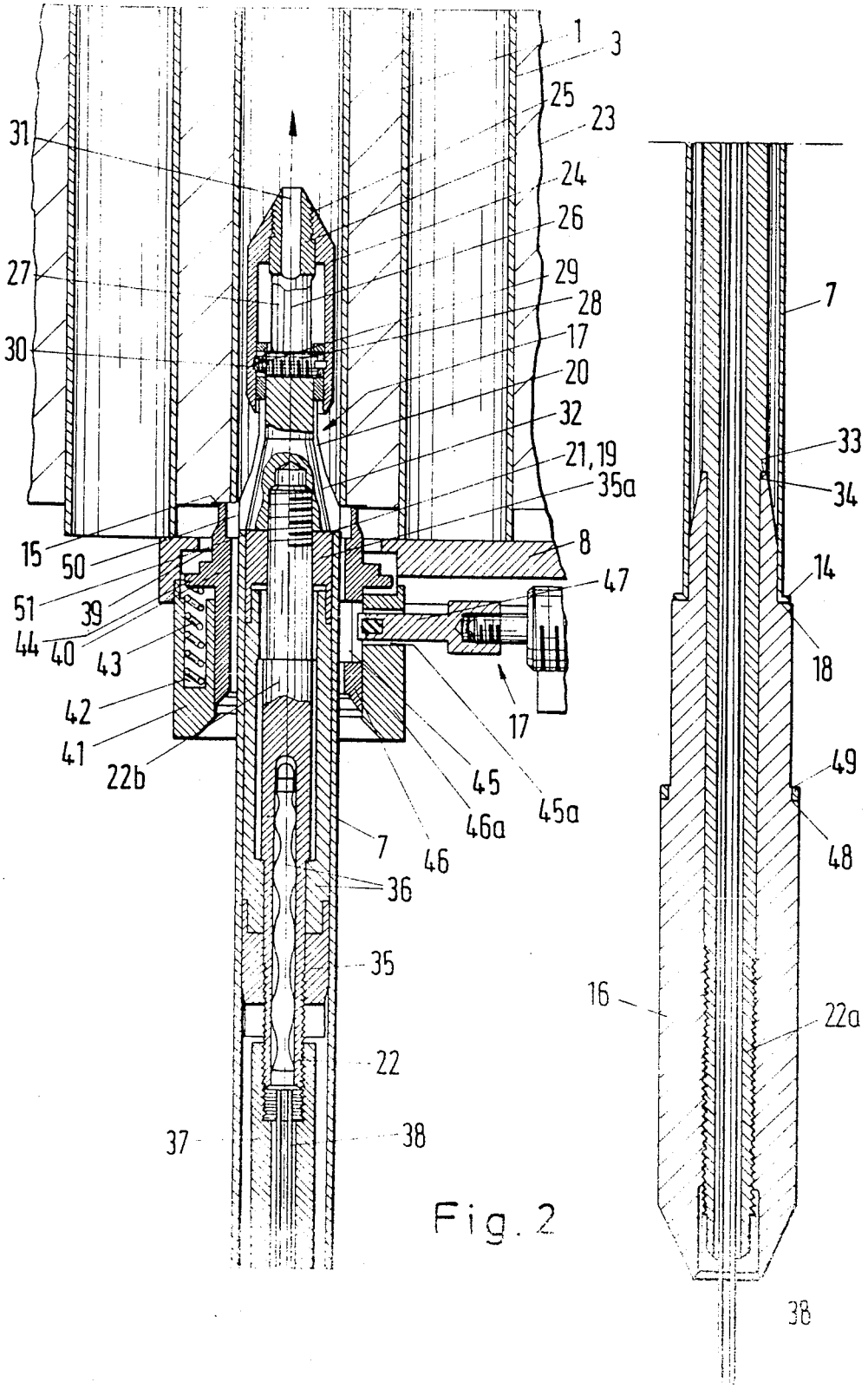
FIG. 2 is an enlarged, fragmentary, cross-sectional view of part of a steam generator tube sheet with upper and lower parts of a clamped sleeve.

According to FIG. 2, in order to accomplish a centered entry and positionally accurate placement of a flanged rim 14 of the sleeve on a bearing surface 15 of the tube sheet 1 during remote-controlled introduction of the sleeve 7, the sleeve 7 is clamped between a holding grip 16 and a centering piece 17. In the illustrated construction, the flanged rim 14 of the sleeve bears against a first shoulder 18 of the holding grip 16, while an end surface 19 of a spreading sleeve 20 of the centering piece 17 contacts an end surface 21 of the sleeve 7 facing the tube sheet 1. The clamping force is applied by a tie rod 22, which has a lower end screwed into the holding grip 16 and an upper end screwed into one end of a spreading bolt 23 of the centering piece 17. The threaded sleeve 24 of the centering piece 17 engages the spreading sleeve 20 and the spreading bolt 23. The threaded sleeve engages an external thread 25 on the other end of the spreading bolt 23. The spreading bolt 23 is provided with a slot 27 running parallel and perpendicular to the axis 26 of the spreading bolt. A resilient locking bolt 28 is extended through the slot 27 and is screwed into the spreading sleeve 20. The locking bolt 28 has a ball 29 spring-mounted thereon, which protrudes beyond the outside diameter of the cylindrical part of the spreading sleeve 20 and which clips into an inner groove 30 of the threaded sleeve 24 with corresponding axial displacement of the spreading sleeve. This displacement takes place when the centering piece is assembled but not yet connected to the tie rod 22, with the aid of a non-illustrated push rod to be guided manually. The push rod is introduced through a center bore 31 in the spreading bolt 23 and contacts the locking bolt 28. The spreading sleeve has non-illustrated longitudinal slits. With this axial movement of the spreading sleeve relative to a spreading cone 32 of the spreading bolt 23, the centering piece with the spreadable part of the spreading sleeve arrives at an outside diameter which is greater than the outside diameter of the sleeve 7 but less than the inside diameter of the tube 3.

The clamping of the sleeve 7 takes place outside the steam generator chamber 5. A lower part 22*a* of the tie rod 22 which is split in two, is screwed into the holding grip 16 until a collar 33 of the lower part 22*a* comes into contact with an end surface 34 of the holding grip 16. Then, by interposing a ring 35, an upper part 22*b* of the tie rod 22 is screwed into the lower part 22*a* of the tie rod 22 with a cartridge 36 associated with it, until the cartridge comes into contact with the ring 35. The cartridge, which is generally designated by reference numeral 36, is carried by the part 22*b* of the tie rod 22. The construction of the cartridge 36, which is used to achieve the expansion of the sleeve 7 after its positioning by means of a detonation charge, is not explained in further detail. All that will be mentioned is that detonator cables 38 are lead to it through a cavity 37 in the tie rod 22. Once the upper part 22*b* has been screwed into the lower part 22*a*, the sleeve 7 is pushed on until it sits on the shoulder 18 of the holding grip 16. Then, the centering piece 17, which is brought into a locking position between the threaded sleeve 24 and the spreading sleeve 20 as explained above, is screwed onto the upper part 22*b* until its spreading bolt 23 comes into contact with a ring 35*a* disposed above the cartridge 36, and the surface of its spreading sleeve 20 comes into contact with the sleeve 7. The thus clamped sleeve 7 is then transferred to the apparatus already disposed in the steam generator chamber 5 and pushed in partial strokes into the tube 3 to be repaired. Since it is equipped with the centering piece 17, the sleeve 7 can consequently be pushed into the tube without any trouble, even if the axes of sleeve and the tube are not exactly aligned. The holding device 12 which is displaceable in axial direction of the steam generator has not been shown in FIG. 2. It should just be mentioned that the clamping jaws of the holding device 12 are constructed in such a way that they can grasp both the sleeve 7 itself and the holding grip 16 with a relatively large diameter without any trouble.

As can be seen from the left-hand half of FIG. 2, the holding plate 8 which is fixed on the tube sheet 1 and in which the stationary holding device is integrated, has an aperture or bore for the sleeve 7 coaxial to a tube 3, in which a resiliently supported connecting sleeve 40 is disposed. The connecting sleeve 40 is guided in a bush 41 connected to the holding plate 8. Clearances 42 have been made in the bush 41 from the end surface of the bush facing the holding plate 8, for receiving compression springs 43. In this configuration, the connecting sleeve 40 supports itself on the springs 43 protruding beyond the end surface of the bush 41, through a flange 44 associated therewith. The resilient suspension ensures that once the holding plate 8 has been fixed relative to the tube sheet 1, the upper rim of the connecting sleeve 40 is bound to come into contact with the bearing surface 15 for the flanged rim 14 of the sleeve 7. The inside diameter of the connecting sleeve 40 must in this case be made larger than the outside diameter of the flanged rim 14 to make it possible for it to pass through. A clearance 45, 45*a* is formed through the wall 46, 46*a* of connecting sleeve 40 and the bush 41. The clearance 45 of the connecting sleeve 40 is made large enough in its longitudinal dimension that a clamping piece 47 of the stationary holding device 13 can be inserted without any difficulties in each position of the connecting sleeve. The rim of the connecting sleeve 40 facing away from the tube sheet 1 is offset in the form of steps, with the end surface of a step being fitted with a contact. As can be seen from the right-hand half of FIG. 2, underneath the shoulder 18 the holding grip 16 has a second shoulder 48. The shoulder surface of the shoulder 48 of the holding grip 16 is associated with a copper ring 49. The upward movement of the holding device 12 is interrupted when the the copper ring touches the contact of the connecting sleeve 40. The second shoulder 48 is spaced from the tube sheet 1 by an axial distance being greater than the spacing between the first shoulder 18 and the tube sheet 1 by an amount substantially equal to the height of the connecting piece 40. Since the distance between the copper ring 49 and the surface of the flanged rim 14 of the sleeve 7 on the holding grip 16 coming into contact with the tube sheet 1 is matched to the distance between the end surface of the connecting sleeve 40 bearing the contact and the bearing surface 15 for the flanged rim 14 on the tube sheet 1, the sleeve 7 can be positioned exactly.

Once the sleeve 7 has been positioned, the expanding of the sleeve, and thus the bonding connection between the outer wall surface of the sleeve and the inner wall surface of the tube, takes place with the aid of the cartridge 36.

By pulling on the holding grip 16 with the aid of the vertically movable holding device 12, the locking bolt 28 is released from the inner groove 30 of the threaded sleeve 24 of the centering piece 17, as a result of which the spreading sleeve 20 is inevitably relaxed to its outside diameter, which is smaller than the inside diameter of the sleeve 7. When the holding grip 16 moves down further with the tie bar 22, the inward movement of the spreading sleeve is assisted by corresponding bevels 50, 51 of the end surfaces of sleeve 7 and the spreading sleeve 20, if it has not already assumed the outside diameter necessary for the sleeve 7 to pass through.

Figure 3:
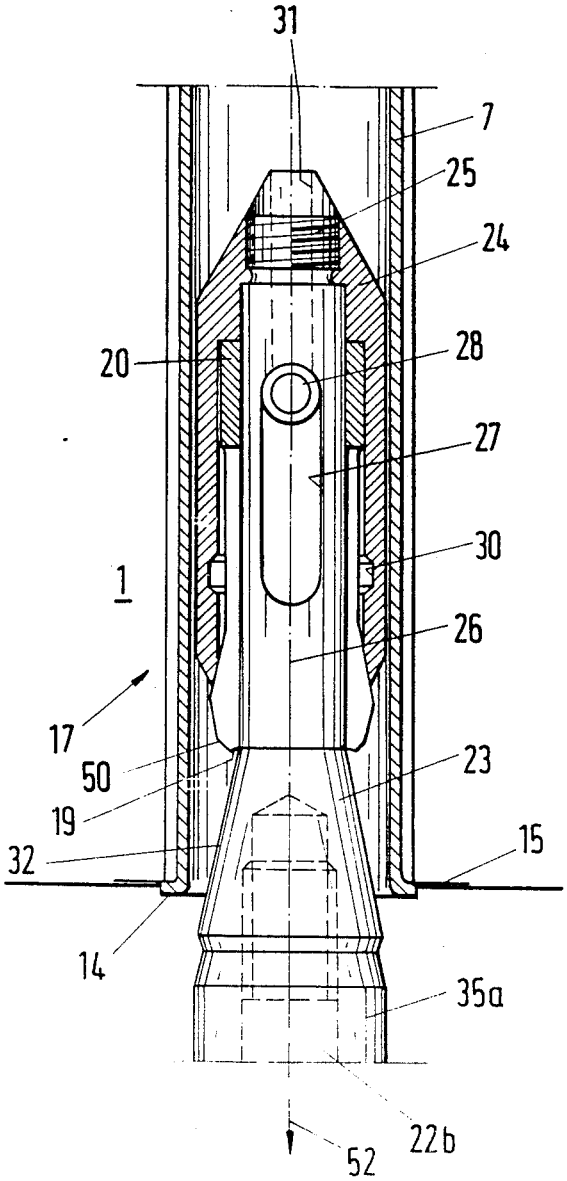
FIG. 3 is a further enlarged, cross-sectional view of a centering piece during a return movement thereof out of the sleeve connected to the steam generator tube.

FIG. 3 shows a centering piece 17 which has been moved together in this way, on its way back in the direction of an arrow 52 out of the sleeve 7 bonded to the tube 3. The locking bolt 28 in this case has reached the upper end of the slot 27, so that the spreading sleeve even assumes a smaller diameter than the threaded sleeve 24.

The foregoing is a description corresponding in substance to German Application No. P 38 12 351.7, dated Apr. 14, 1988, the International priority of which is being claimed for the instant application, and which is hereby made part of this application. Any material discrepancies between the foregoing specification and the aforementioned corresponding German application are to be resolved in favor of the latter.

I claim:

1. Apparatus for the introduction of a repair sleeve into a tube ending in a tube sheet of a steam generator, comprising a holding plate being fixed relative to the tube sheet and having an aperture formed therein coaxially with the tube, a stationary holding device associated with the tube sheet and integrated in said holding plate, a movable holding device being movable in axial direction of the steam generator for transferring the repair sleeve in partial strokes to said stationary holding device and for performing a return stroke, a connecting sleeve being resiliently supported in axial direction of said connecting sleeve in said aperture, said connecting sleeve having a given height, a given inside diameter, an end surface facing away from the tube sheet and an end surface facing toward and contacting the tube sheet, a holding grip including a first shoulder having a surface with a greatest diameter being smaller than said given inside diameter of said connecting sleeve and a second shoulder with a surface for contacting said end surface of said connecting sleeve facing away from the tube sheet, said first shoulder being spaced from the tube sheet by a first axial distance along the axis of said holding grip, said second shoulder being spaced from the tube sheet by a second axial distance along the axis of said holding grip being greater than said first axial distance by an amount substantially equal to said given height, and a centering piece with a variable outside diameter, the repair sleeve being clamped between said first shoulder and said centering piece during the return stroke of said holding device.

2. Apparatus according to claim 1, wherein the tube has an inner wall surface and the repair sleeve has an outer wall surface, and including a tie rod passing through the repair sleeve and extending between and interconnecting said centering piece and said holding grip, and an expanding device disposed on said tie rod for establishing a connection between the outer wall surface of the repair sleeve and the inner wall surface of the tube once positioning of the repair sleeve has taken place.

3. Apparatus according to claim 1, wherein said connecting sleeve has a flange, and including a bush associated with said holding plate for guiding said connecting sleeve, said bush having an end surface facing said holding plate with clearances formed therein, and springs disposed in said clearances and protruding beyond said end surface of said bush for supporting said flange.

4. Apparatus according to claim 3, wherein said connecting sleeve has an axis and an inner wall surface, said bush and said connecting sleeve have walls with clearances formed therein opposite said inner wall surface of the connecting sleeve, said stationary holding device has a clamping piece movable substantially perpendicularly to said axis of said connecting sleeve and passing through both of said clearances, and the repair sleeve is clamped by pressing against said inner wall surface of said connecting sleeve.

5. Apparatus according to claim 4, wherein said springs have a given excursion along which said flange of said connecting sleeve is supported by said springs, and said clearance formed in said wall of said connecting sleeve has an axial dimension large enough to permit said connecting sleeve to pass through with said clamping piece while said flange of said connecting sleeve is supported by said springs along all of said given spring excursion.

6. Apparatus according to claim 1, including a contact being triggered for interrupting entry movement of the repair sleeve once said second shoulder of said holding grip contacts said end surface of said connecting sleeve facing away from the tube sheet.

7. Apparatus according to claim 2, wherein the repair sleeve has an end surface, said centering piece includes a spreading bolt having one end to be connected to said tie rod, another end, an axis and a slot penetrating said spreading bolt transverse to said axis thereof, a spreading sleeve engaging said spreading bolt and having an end surface and an outside diameter, and a threaded sleeve partially engaging said spreading bolt and said spreading sleeve and being connected to said other end of said spreading bolt, a locking bolt passing through said slot, being fixed in said spreading sleeve and protruding beyond said outside diameter of said spreading sleeve, a ball spring-mounted on said locking bolt to be clipped into an inner groove formed in said threaded sleeve, when said end surface of said spreading sleeve contacts the end surface of the repair sleeve.

8. Apparatus according to claim 7, wherein said other end of said spreading bolt has a center bore formed therein in communication with said slot for receiving a push rod for displacing said locking bolt into clipped engagement with said inner groove, before connecting said spreading bolt to said tie rod.

9. Apparatus according to claim 7, wherein said threaded sleeve is released by said spreading sleeve, and the outside diameter of said centering piece is reduced to a dimension allowing a movement of said centering piece through the repair sleeve, once a connection between the outer wall surface of the repair sleeve and inner wall surface of the tube has been established by a movement of said tie rod away from the tube sheet.

10. Apparatus according to claim 7, wherein said end surface of said spreading sleeve has a bevel formed thereon.

11. Apparatus according to claim 10, wherein the end surface of the repair sleeve faces said centering piece and has a bevel formed thereon, said bevel on said spreading sleeve being contacted by the bevel on the repair sleeve during pulling movement of said tie rod.

* * * * *